US007100407B2

(12) United States Patent
Chen

(10) Patent No.: US 7,100,407 B2
(45) Date of Patent: Sep. 5, 2006

(54) HANDLED LOCK SET FOR A DOOR

(75) Inventor: Po-Yang Chen, Chia-Yi (TW)

(73) Assignee: Tong-Lung Metal Industry Co., Ltd., Chia-Yi (TW)

( * ) Notice: Subject to any disclaimer, the term of this patent is extended or adjusted under 35 U.S.C. 154(b) by 79 days.

(21) Appl. No.: 10/856,017

(22) Filed: May 28, 2004

(65) Prior Publication Data

US 2004/0237608 A1 Dec. 2, 2004

(30) Foreign Application Priority Data

May 30, 2003 (TW) ..... 92210074 U

(51) Int. Cl.
*E05B 13/10* (2006.01)

(52) U.S. Cl. ..... 70/224; 70/223; 70/472; 292/DIG. 27

(58) Field of Classification Search ..... 70/149, 70/210, 215–218, 221–224, 467–489, 422, 70/380, 379 R, 379 A, DIG. 42; 292/169.16, 292/169.22, 169.23, 336.5, DIG. 27, DIG. 52, 292/DIG. 62, 336.3
See application file for complete search history.

(56) References Cited

U.S. PATENT DOCUMENTS 1,060,413 A * 4/1913 Augenbraun ..... 70/107
1,495,820 A * 5/1924 Tierney ..... 70/108
2,618,955 A * 11/1952 Cerf, Jr. ..... 70/476
2,871,047 A * 1/1959 North et al. ..... 292/169.13
2,983,537 A * 5/1961 Kubik ..... 292/169.16
4,428,212 A * 1/1984 Best et al. ..... 70/224
4,635,453 A * 1/1987 Hart ..... 70/134
5,074,607 A * 12/1991 Lin ..... 292/359
5,301,526 A * 4/1994 Fann et al. ..... 70/224
5,372,025 A * 12/1994 Lin ..... 70/472
5,784,909 A * 7/1998 Huang ..... 70/224
5,788,296 A * 8/1998 Kuo et al. ..... 292/358
5,809,815 A * 9/1998 Lee ..... 70/472
5,868,018 A * 2/1999 Kang ..... 70/472
5,927,777 A * 7/1999 Kuo et al. ..... 292/358
6,216,500 B1 * 4/2001 Kang ..... 70/224
6,470,721 B1 * 10/2002 Ming ..... 70/224
6,536,249 B1 * 3/2003 Wu ..... 70/467
6,742,367 B1 * 6/2004 Wu ..... 70/224
6,807,833 B1 * 10/2004 Huang et al. ..... 70/107
2002/0066297 A1 * 6/2002 Wu et al. ..... 70/472

* cited by examiner

*Primary Examiner*—Lloyd A. Gall
(74) *Attorney, Agent, or Firm*—Ladas & Parry LLP

(57) ABSTRACT

A lock set includes a hollow intermediate spindle connected to a door latch and to an inner handle assembly, a turning rod extending inside the intermediate spindle, a coupler connected to a key-operated lock of an outer handle assembly so as to be turned thereby and connected to the turning rod so as to actuate the turning rod, a first clutch plate fitted around the turning rod for rotation together with the turning rod, and a second clutch plate movably disposed around the turning rod for sliding away from or toward the first clutch plate. In a preferred embodiment, the coupler has a hole to receive a tail end of the key-operated lock. The tail end is rotatable limitedly within the hole of the coupler.

10 Claims, 9 Drawing Sheets

HANDLED LOCK SET FOR A DOOR

CROSS-REFERENCE TO RELATED APPLICATION

This application claims priority of Taiwanese Utility Application No. 92210074, filed on May 30, 2003.

BACKGROUND OF TE INVENTION

1. Field of the Invention

This invention relates to a door lock, more particularly to a lock set which has inner and outer handle assemblies through which a door latch can be operated to latch or unlatch a door.

2. Description of the Related Art

In order to provide door locks with diverse functions desired for different purposes and applications, various forms of lock sets having inner and outer handles have been suggested in the art. One example of such lock sets includes an inner handle assembly provided with a locking spindle having a knob which can be operated by the user from the inside of the door to lock the door, or to lock permanently a lock body mounted inside an outer handle permanently while permitting the outer handle assembly to idle until the locking spindle is operated to an unlocking position.

Another type of lock set has an inner handle assembly which is not provided with any locking spindle and which can be rotated freely even when an outer handle assembly is locked. The outer handle assembly may be locked or unlocked by operating it with a key.

There is still another type of lock set with a freely rotatable inner handle assembly which has no locking spindle and with an outer handle assembly which can be unlocked with a key. But, when the key is withdrawn from the outer handle assembly, the outer handle assembly is locked back.

U.S. Pat. No. 5,788,296 discloses a lock set which includes a hollow outer spindle mounted on an outer handle assembly, a hollow intermediate spindle connected to an inner handle assembly for connection with a door latch, and a turning rod extending inside the intermediate and outer spindles. Two slide plates and two clutch plates are mounted on the turning rod inside the outer spindle. With the clutch plates mounted on the turning rod, the outer handle assembly is permitted to idle when a lock body provided therein is in a locking state. When a key is inserted into the lock body, the lock body can be rotated by turning the key to unlock a door. However, the door must be opened before the key is withdrawn from the lock body. If the key is withdrawn from the lock body, since the key has to be turned back for withdrawal, the lock body can be turned together with the key to its locking position, and the door can be locked back and cannot be opened.

SUMMARY OF THE INVENTION

An object of the present invention is to provide an improvement over a lock set of the type disclosed in U.S. Pat. No. 5,788,296.

Another object of the present invention is to provide an improved handled lock set which permits a door to open even after the key is withdrawn from the lock body.

According to this invention, a lock set for a door, comprises: an inner handle assembly; an outer handle assembly; a key-operated lock mounted inside the outer handle assembly and having a tail end; a hollow outer spindle mounted inside the outer handle assembly for simultaneous rotation therewith; a hollow intermediate spindle having an inner end connected to the inner handle assembly; a turning rod extending inside the intermediate and outer spindles, and having inner and outer ends; a coupler disposed inside the outer spindle and having an outer end connected to the tail end of the lock so as to be turned by the lock, and an inner end connected to the outer end of the turning rod so as to actuate the turning rod; a first clutch plate fitted around the turning rod adjacent to the outer end of the turning rod for rotation together with the turning rod; and a second clutch plate disposed around the turning rod for sliding along the turning rod in a direction away from or toward the first clutch plate. The first clutch plate has a cam surface that cams the second clutch plate to move away from the first clutch plate or permits the second clutch plate to move toward the first clutch plate.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
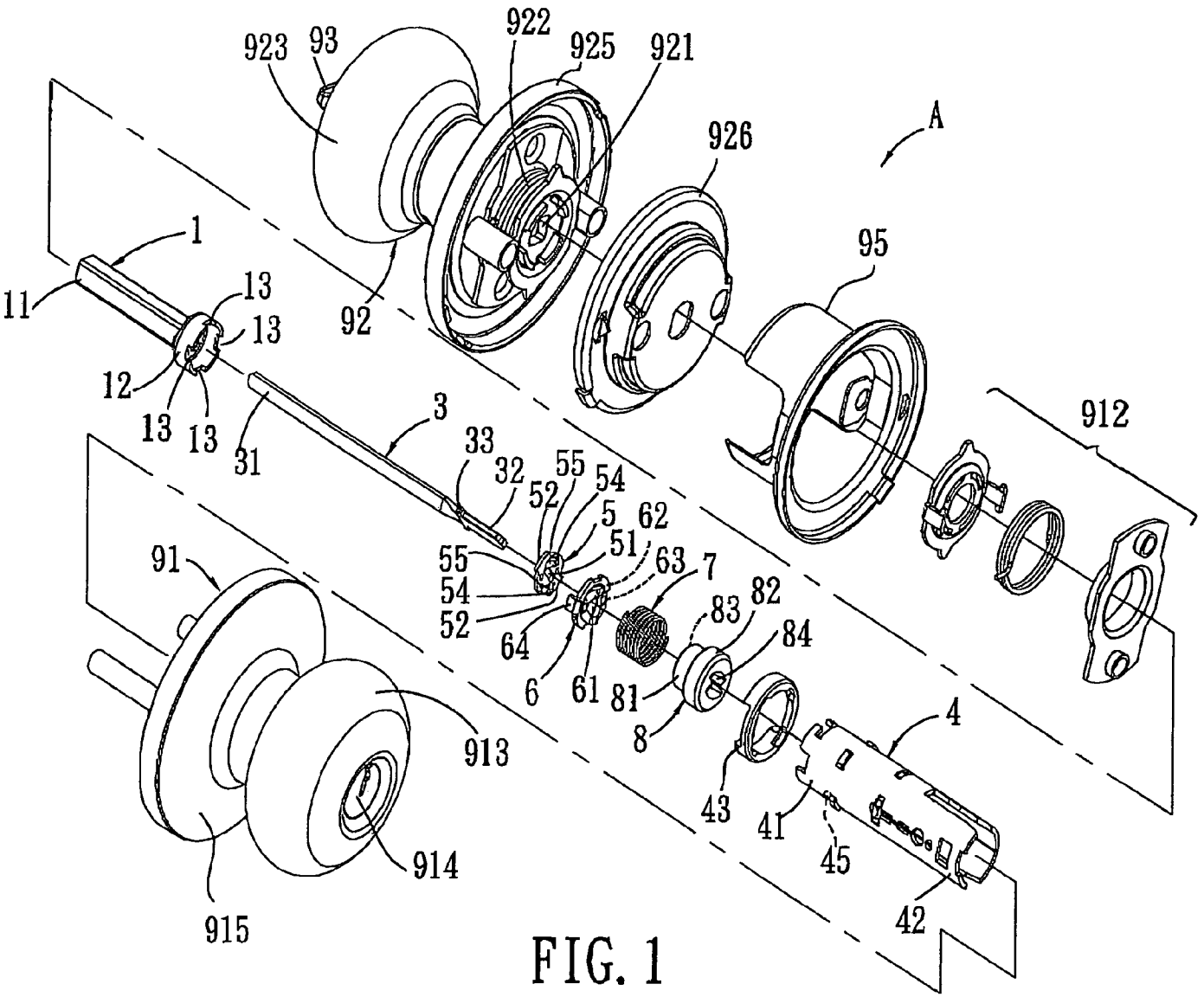
FIG. 1 is an exploded view of the first preferred embodiment of the present invention.
Figure 1A:
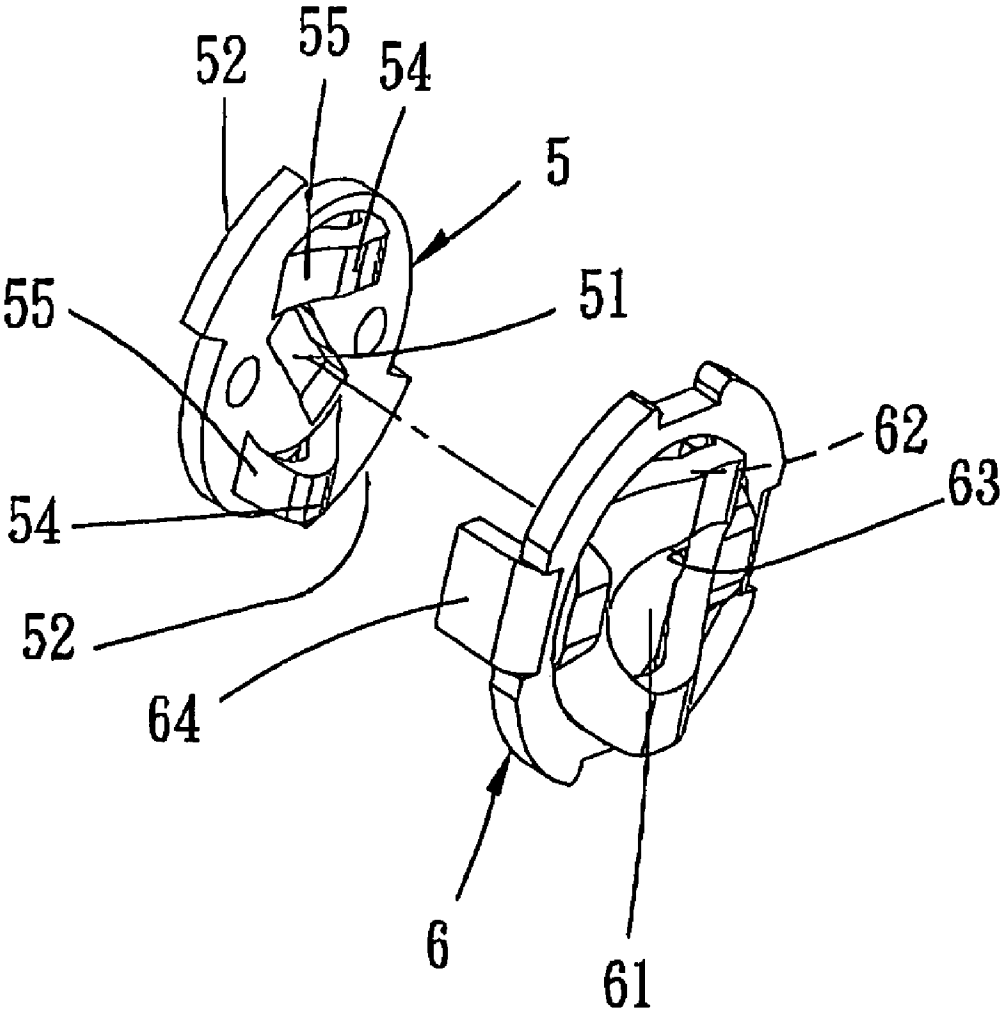
FIG. 1A is an enlarged view of clutch plates shown in FIG. 1.
Figure 1B:
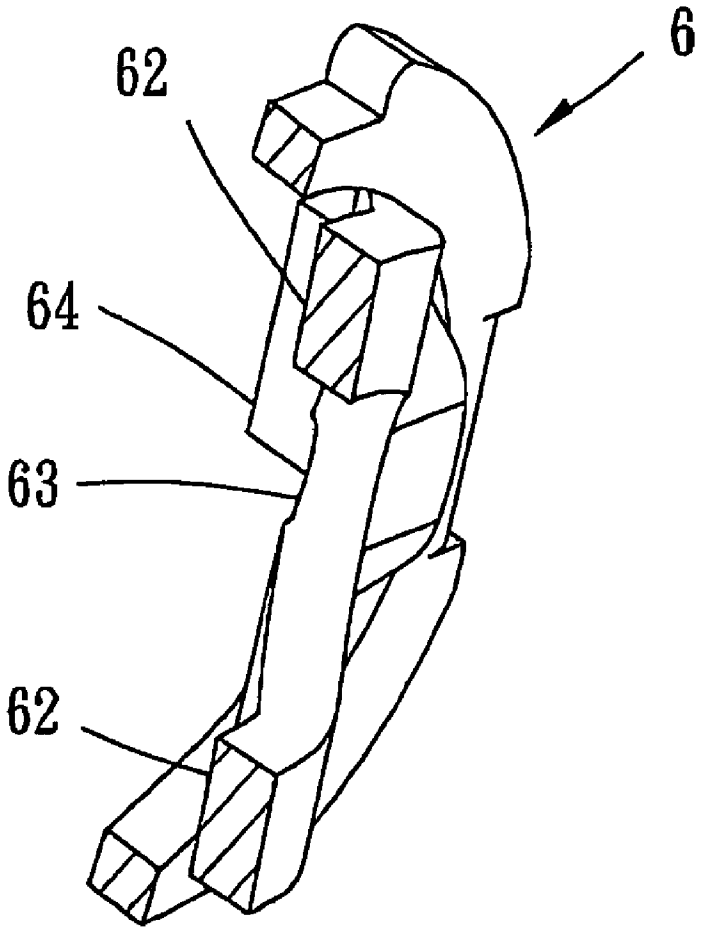
FIG. 1B is a fragmentary view of one of the clutch plates of FIG. 1A.
Figure 2:
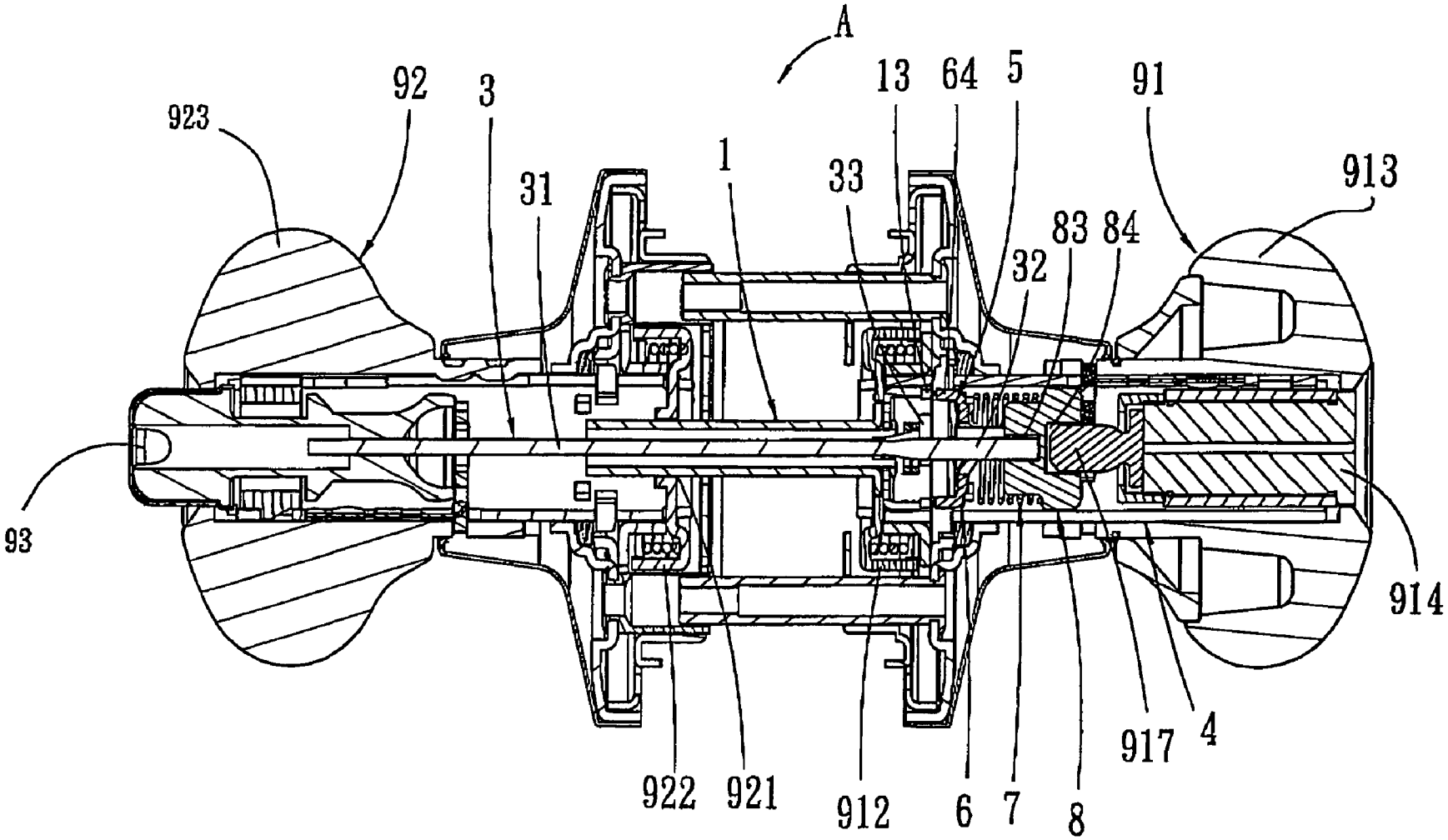
FIG. 2 is a sectional view of the first preferred embodiment.

Before the present invention is described in greater detail, it should be noted that same reference numerals have been used to denote like elements throughout the specification.

Referring to FIGS. 1, 1A, 1B and 2, a first preferred embodiment of the present invention is shown to include a lock set (A) mountable on a door panel. The lock set (A) includes an outer handle assembly 91, an inner handle assembly 92, a casing 95 for holding a door latch (not shown) connected between the outer and inner handle assemblies 91 and 92. The inner handle assembly 92 includes an inner knob 923 associated with an inner cap 925 to be mounted on the door panel (not shown) and a returning mechanism 922 mounted inside the inner cap 925 for returning the inner knob 923 to an original position after the inner knob 923 is turned by a user. A locking spindle 93 is mounted inside the inner knob 923 to be operated by the user from the inside of the door. A fence plate 926 covers the returning mechanism 922. The outer handle assembly 91 includes an outer knob 913 associated with an outer cap 915 and a returning mechanism 912 mounted inside the outer cap 915 for returning the outer knob 913 to its original position after the outer knob 913 is turned by the user. A key-operated lock 914 is mounted inside the outer knob 913 to be operated from the outside of the door. Since the constructions of the outer and inner handle assemblies 91, 92 are known, the details thereof are not described herein for the sake of brevity.

The lock set (A) further includes a hollow intermediate spindle 1 of square cross-section which is adapted to connect with the door latch (not shown). An inner end 11 of the intermediate spindle 1 is fitted into a hole 921 of the inner handle assembly 92 so that the intermediate spindle 1 can be rotated by the inner handle assembly 92. The intermediate spindle 1 further has an outer end enlarged to form a cup 12 having a distal end provided with dents 13. A turning rod 3 extends through the intermediate spindle 1, and includes an inner end 31 connected directly to the locking spindle 93 of the inner handle assembly 92, and an outer end 32 extending toward the outer handle assembly 91. A retaining piece 33 is formed on the turning rod 3 adjacent to the outer end 32.

A hollow outer spindle 4 is mounted within the outer handle assembly 91 and is sleeved around the key-operated lock 914. A reinforcing ring 43 is sleeved around the outer spindle 4.

Figure 3:
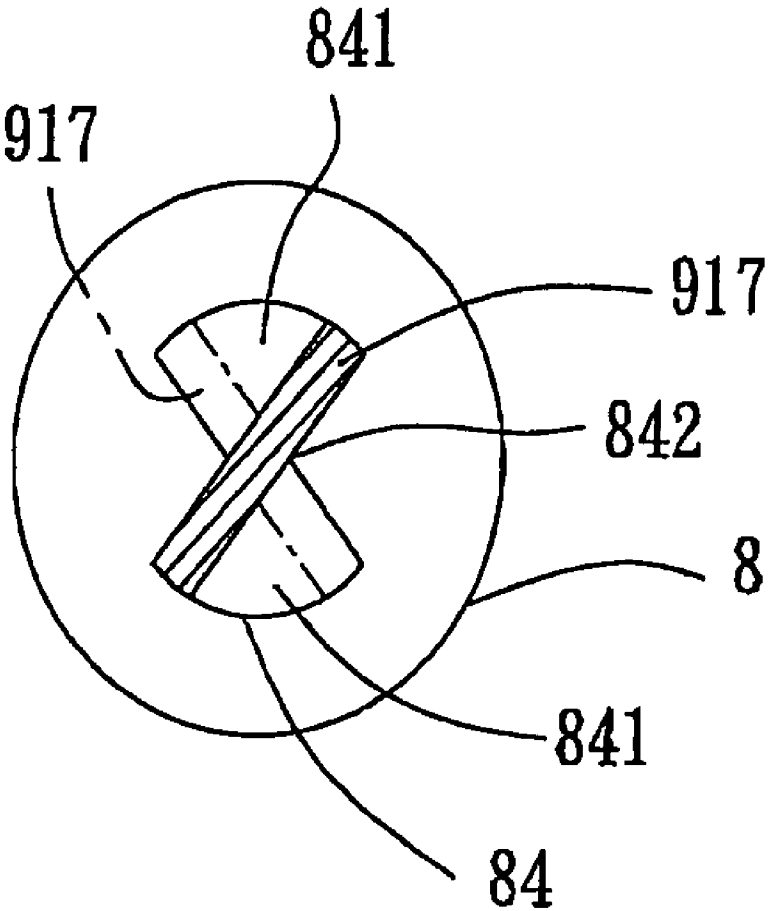
FIG. 3 is a plan view of a coupler shown in FIG. 1.

According to the present invention, a coupler 8 is combined with an assembly of first and second clutch plates 5 and 6. The combination thereof is provided within the outer spindle 4 adjacent to an inner end 41 thereof. The coupler 8 has a neck part 81, an enlarged head part 82, an inner hole 83 formed in the neck part 81, and an outer hole 84 of substantially figure eight-shape formed in the head part 82. The outer hole 84 has a cross-sectional shape which is formed by two sectors 841 having tapered ends overlapping each other at 842, as best shown in FIG. 3. A plate-like tail 917 of the key-operated lock 914 is inserted into the outer hole 84, and the outer end 32 of the turning rod 3 is received in snug fit in the inner hole 83. A coiled spring 7 is sleeved around the neck part 81 of the coupler 8 in abutment with the head part 82.

The first clutch plate 5 includes a rectangular central hole 51, edge faces 52 proximate to the inner surface of the wall of the outer spindle 4, and a pair of diametrically opposed wedge-shaped protrusions 54 projecting from one side of the first clutch plate 5 facing the second clutch plate 6. The wedge-shaped protrusions 54 have inclined cam surfaces 55. The turning rod 3 is inserted fittingly in the hole 51 so that the first clutch plate 5 is rotatable together with the turning rod 3.

The second clutch plate 6 has a central hole 61 for passage of the turning rod 3, a pair of diametrically opposed deep recesses 62 formed on two sides of the central hole 61, and another pair of diametrically opposed shallow recesses 63 each of which is spaced apart angularly from the deep recesses 62 by an angle of 90 degrees. A pair of prongs 64 project from the second clutch plate 6 adjacent to the shallow recesses 63 for engagement with the dents 13 of the intermediate spindle 1. The second clutch plate 6 can be moved along the turning rod 3 by the action of the cam surfaces 55 or by the spring 7 so that the prongs 64 are engageable with or disengageable from the dents 13. To enable the second clutch plate 6 to rotate together with the outer spindle 4, two bosses 45 are formed on an inner surface of the outer spindle 4 on two sides of each prong 64. These bosses 45 also serve to guide each prong 64 to move axially toward or away from the corresponding dent 13 of the intermediate spindle 1.

In assembly, a portion of the turning rod 3 between the outer end 32 and the retaining piece 33 extends through the hole 51 of the first clutch plate 5, the hole 61 of the second clutch plate 6 and the coiled spring 7. The outer end 32 of the turning rod 3 is inserted in snug fit into the hole 83 of the coupler 8. The second clutch plate 6 is urged by the coiled spring 7 to contact against the first clutch plate 5 and to cause the prongs 64 to engage the dents 13 of the intermediate spindle 1. The cam surfaces 55 of the first clutch plate 5 function to cam the second clutch plate 6 to move away from the first clutch plate 5, or permit the second clutch plate 6 to move toward the first clutch plate 5.

The lock set (A) enables the key-operated lock 914 to be in a permanent locking state by turning the lock spindle 93 in the inner handle assembly 92 while permitting the knob 913 of the outer handle assembly 91 to idle.

Furthermore, the lock set (A) may be placed in an unlocking state by turning the locking spindle 93 in the inner handle assembly 92 or by inserting a key into the lock 914 of the outer handle assembly 91 so as to rotate the tail end 917 of the lock 914. The rotation of the tail end 917 causes the coupler 8 and the turning rod 3 to turn. As the turning rod 3 rotates, the wedge-shaped protrusions 54 of the first clutch plate 5 project into the deep recesses 62 of the second clutch plate 6, and the prongs 64 engage the dents 13 of the intermediate spindle 1. Thus, the intermediate spindle 1 is connected to the outer spindle 4, and the door latch (not shown) connected to the intermediate spindle 1 can be operated to move to its unlatching position.

For locking a door, the locking spindle 93 of the inner handle assembly 92 may be turned to rotate the turning rod 3. As the turning rod 3 rotates, the inclined cam surfaces 55 of the protrusions 54 will push the deep recesses 62 of the second clutch plate 6. After the turning rod 3 turns by a predetermined angle (about 90 degrees), the protrusions 54 move into the shallow recesses 63. As a result, the prongs 64 disengage from the dents 13 of the intermediate spindle 1. The lock set (A) is thus placed in a locking state. In this state, if the outer handle assembly 91 with the outer spindle 4 is rotated, it will idle and will not affect the locking state of the lock set (A). However, the rotation of the inner handle assembly 92 can cause the intermediate spindle 1 to actuate the door latch (not shown) to the unlatching position as the inner end 11 of the intermediate spindle 1 is connected directly to the inner handle assembly 92. But, the locking spindle 93 cannot be returned to the unlocking state through the inner handle assembly 91.

While the coupler 8 and the first and second clutch plates 5 and 6 according to the present invention are arranged to cooperate with the locking spindle 93 in the lock set (A), application of the present invention is not limited thereto. The coupler 8 and the first and second clutch plates 5 and 6 may be incorporated into other lock sets which have no locking spindle.

Figure 4:
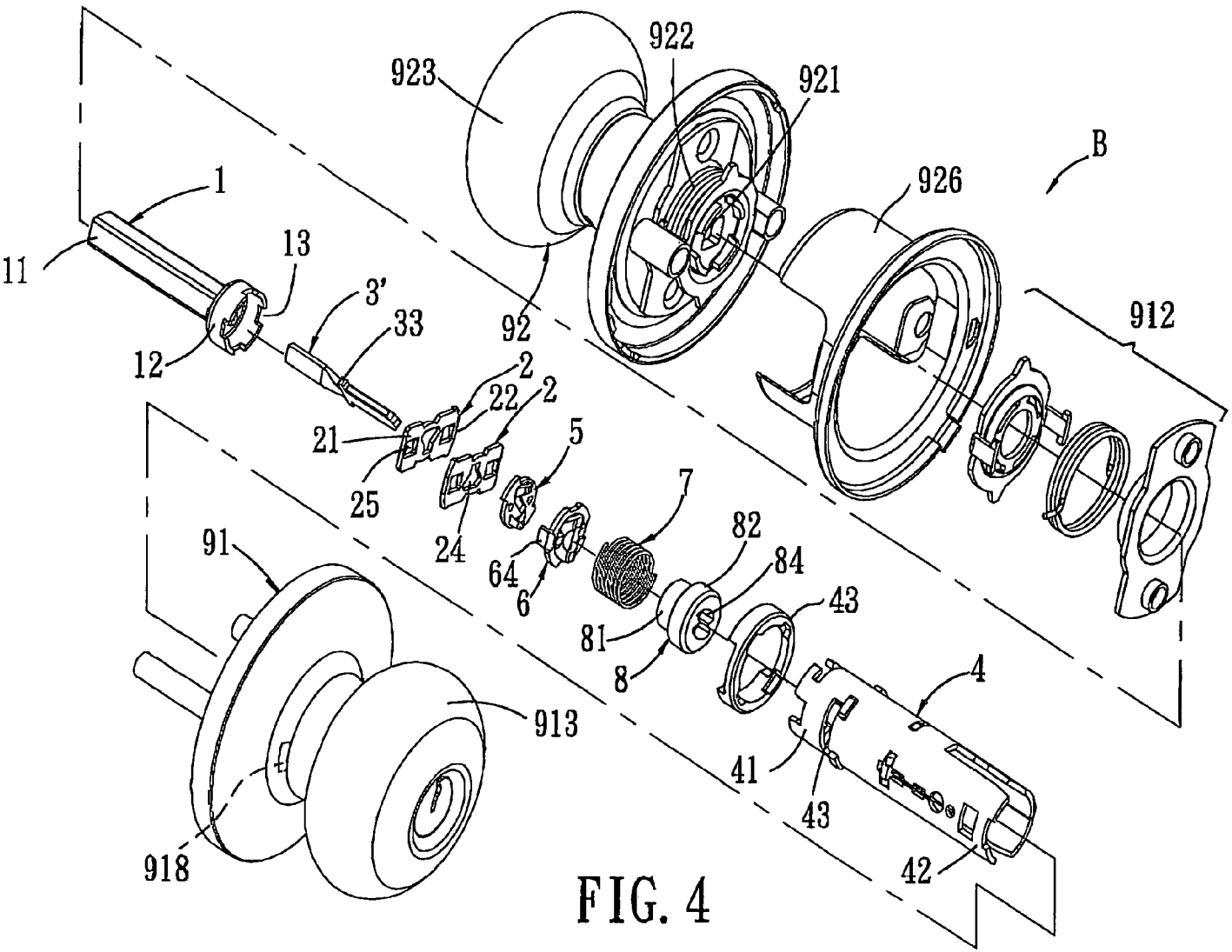
FIG. 4 is an exploded view of the second preferred embodiment of the present invention.
Figure 5:
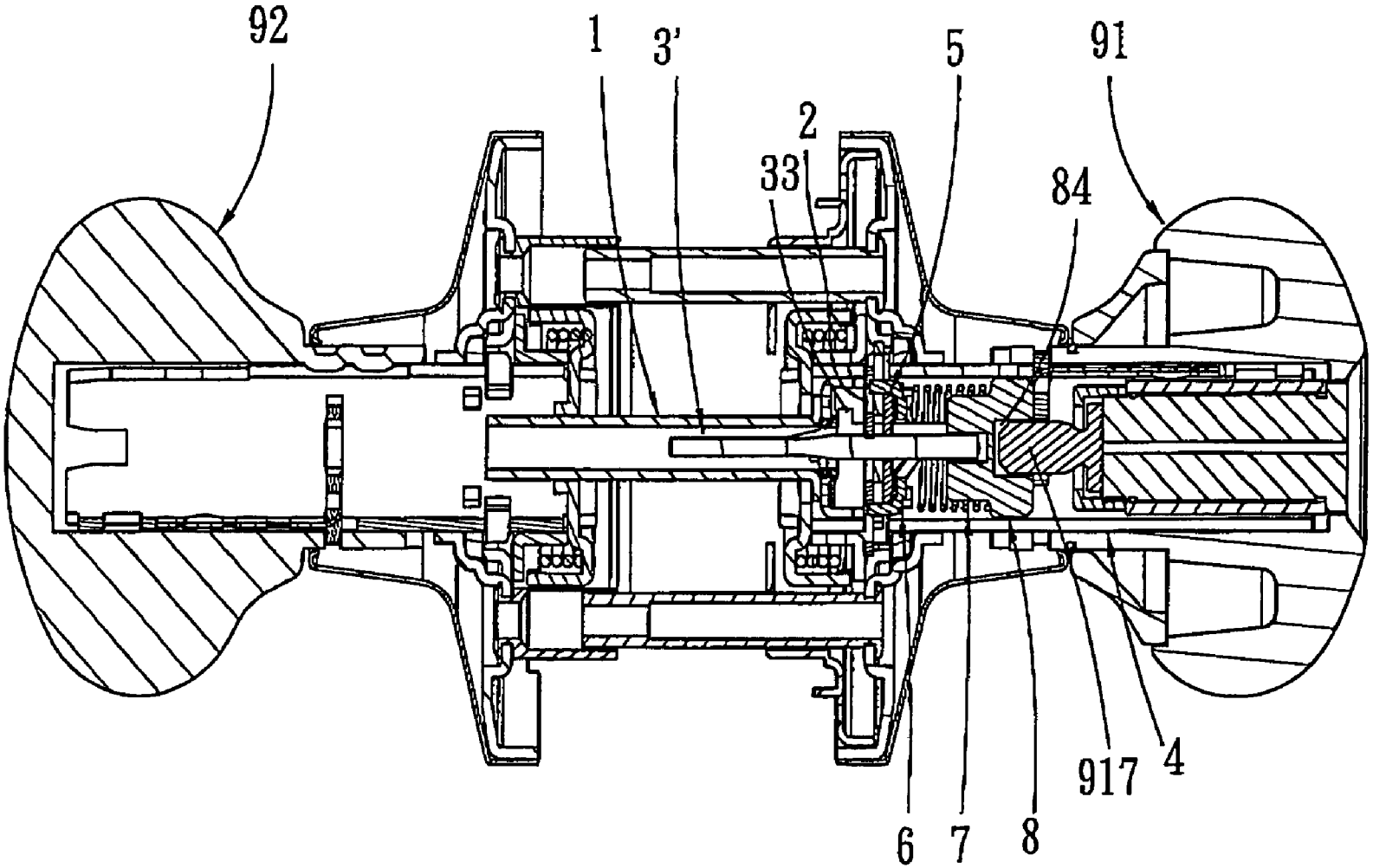
FIG. 5 is a sectional view of the second preferred embodiment.

Referring to FIGS. 4 and 5, a second preferred embodiment of the present invention is shown to include a lock set (B) which is substantially similar in construction to the lockset (A). However, the lock set (B) has no locking spindle in the inner handle assembly 92, and the turning rod 3' does not extend to the inner handle assembly 92. Moreover, a pair of slide plates 2 are sleeved around the turning rod 3' in addition to the coupler 8, and the first and second clutch plates 5 and 6. The slide plates 2 are known. Each slide plate 2 has two diametrically opposed ends 21 and 22, a middle slot 24 for passage of the turning rod 3', and two guide slots 25 for receiving and guiding the prongs 64 of the second clutch plate 6. The outer spindle 4 is provided with two diametrically opposed apertures 43 in alignment with the respective ends 21 and 22 of the slide plates 2. By rotating the turning rod 3', the slide plates 2 can be moved outward in opposite diametric directions through the respective apertures 43 of the outer spindle 4, or retracted inward. When the slide plates 2 project outward, they engage respective grooves 918 provided in the outer handle assembly 91 so that the outer spindle 4 is locked against rotation.

Due to the absence of the locking spindle 93 of the first embodiment, the inner handle assembly 92 can be rotated freely without affecting the locking state of the outer handle assembly 91. The outer handle assembly 91 may be operated by a key to place the lock set (B) in its locking or unlocking state.

When a key is inserted into the lock 914 in the outer handle assembly 91 to rotate the lock 914 to an unlocking position, the tail end 917 of the lock 914 rotates idly by a predetermined angle (about 90 degrees) due to the figure eight-shaped hole 84 of the coupler 8 which receives the plate-like tail end 917 of the lock 914. Specifically, as shown in FIG. 3, the cross-section of the hole 84 is larger than the cross-section of the tail end 917 of the lock 914 so that the tail end 917 is permitted to rotate limitedly by a predetermined angle (about 90 degree) within the hole 84. Therefore, when the lock 914 is rotated, the tail end 917 will idle before it engages the hole 84 to actuate the coupler 8. After idling, the tail end 917 engages the hole 84 and drives the coupler 8, thereby turning the turning rod 3'. As the turning rod 3' is turned, the slide plates 2 retract inward so that the slide plates 2 disengage from the grooves 918 provided in the outer handle assembly 91 to permit the outer spindle 4 to rotate. At the same time, the first and second clutch plates 5 and 6 engage each other through the protrusions 54 and the deep recesses 62, and the prongs 64 engage the dents 13 of the intermediate spindle 1 by the action of the spring 7. In this situation, the door latch (not shown) connected to the intermediate spindle 1 can unlatch the door through the rotation of the outer handle assembly 91.

When a key is inserted into the lock 914 to rotate the lock 914 to a locking position, again, the tail end 917 will idle first and then drive the coupler 8 and the turning rod 3' so that the slide plates 2 are moved outward through the apertures 43 of the outer spindle 4 to engage the grooves 918 in the outer handle assembly 91. At the same time, the second clutch plate 6 moves against the spring 7, and the prongs 64 disengage from the dents 13 of the intermediate spindle 1. After the turning rod 3' turns by 90 degrees, and after the key is removed from the lock 914, the lock set (B) is in a locking state. In this state, rotation of the inner handle assembly 92 can actuate the lock set (B) to an unlocking state, but the outer handle assembly will idle and will not actuate the lock set (B).

In this embodiment, due to the figure eight-shaped hole 84 of the coupler 8, after the lock set (B) is placed in an unlocking state through the key, even when the key is withdrawn from the lock 914, the door will not be locked back and can be opened. This is because the tail end 917 of the lock 914 can idle by a predetermined angle (about 90 degrees) before it actuates the coupler 8. Since the key is turned back only by an angle of about 90 degrees before being withdrawn from the lock 914 and since the tail end 917 can idle until the key is withdrawn, the turning of the tail end 917 during the returning of the key will not cause the turning rod 3' to turn. Thus, the lock set (B) will not return to its locking position.

Figure 6:
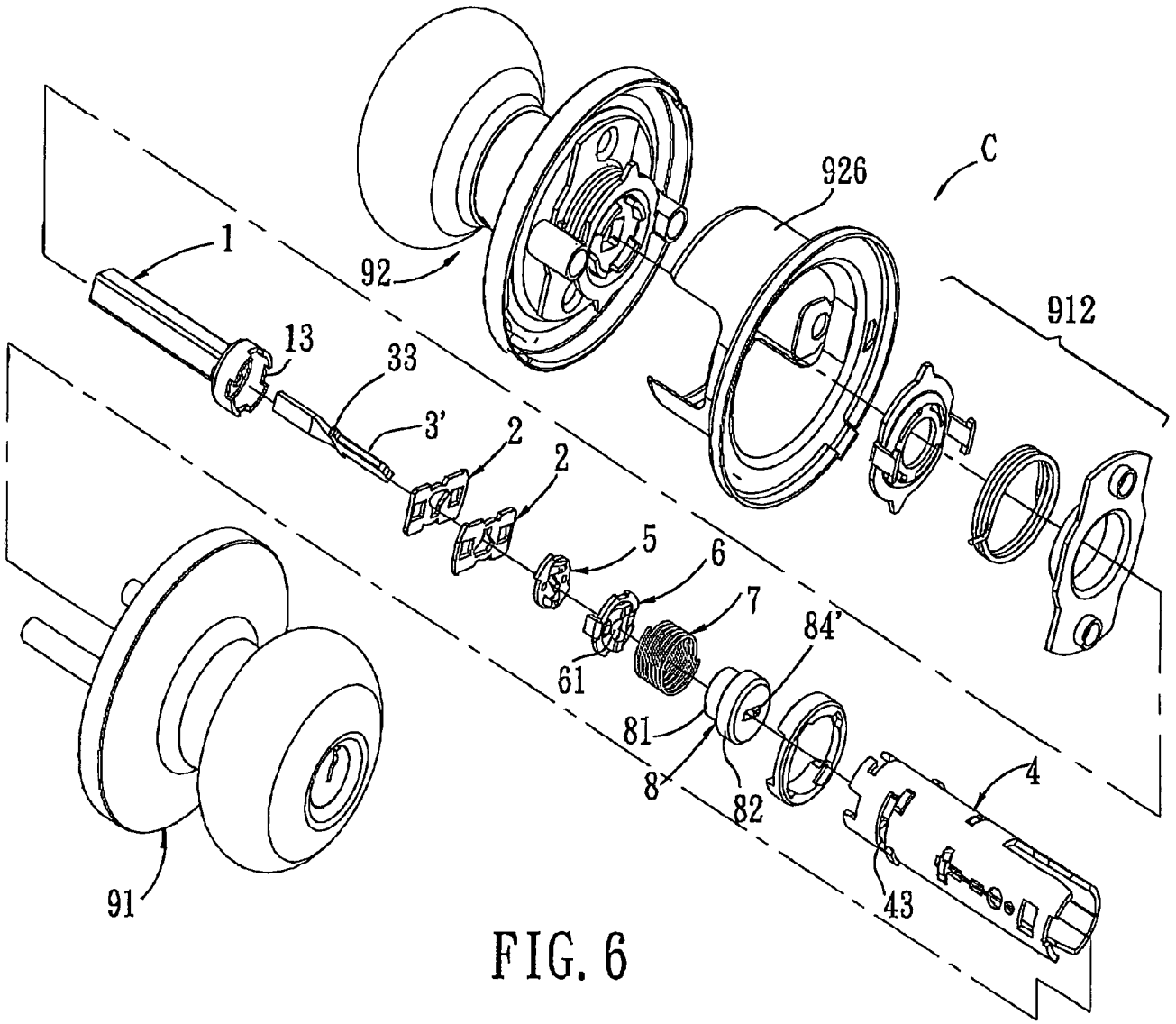
FIG. 6 is an exploded view of the third preferred embodiment of the present invention.
Figure 7:
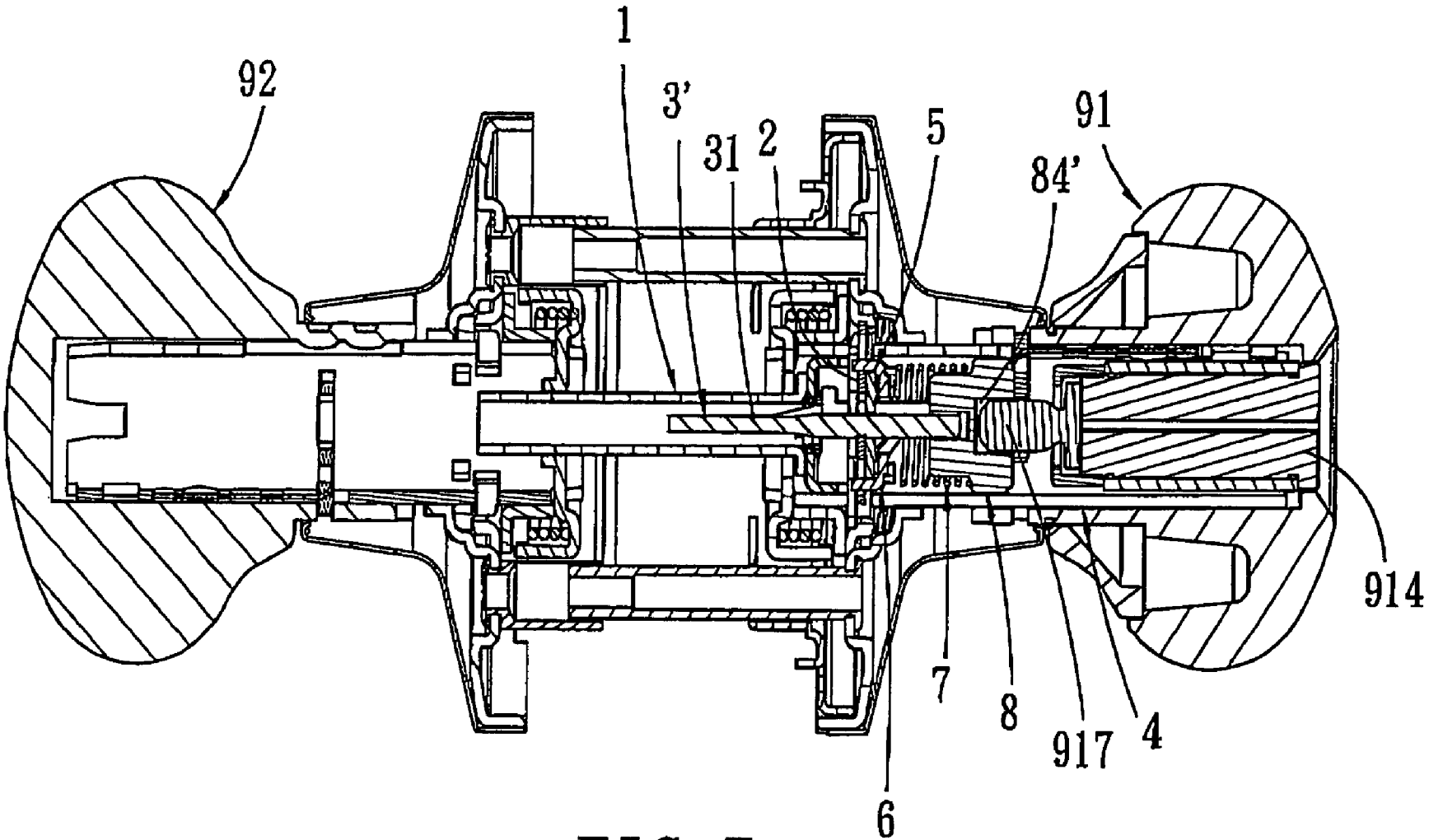
FIG. 7 is a sectional view of the third preferred embodiment.

Referring to FIGS. 6 and 7, a third preferred embodiment of the present invention includes a lock set (C) which is substantially similar to the lock set (B) except that the coupler 8 thereof includes a narrow hole 84' with a cross-section substantially conforming to that of the plate-like tail end 917 of the key-operated lock 914 for receiving the tail end 917 in snug fit. The lock set (C) operates substantially in the same manner as the lock set (B). However, unlike the figure eight-shaped hole 84 of the coupler 8 in the lock set (B), the narrow hole 84' does not permit the tail end 917 of the lock 914 to idle before actuating the coupler 8' and the turning rod 3'. Therefore, when a key which has been inserted into the lock 914 is withdrawn from the lock 914, the door cannot be opened. This is because the rotation of the tail end 917 of the lock 914 is synchronous with the turning actions of the coupler 8 and the turning rod 3' and because the turning rod 3' will actuate the slide plates 2 to project out of the outer spindle 4, move the second clutch plate 6 against the spring 7, and disengage the prongs 64 of the second clutch plate 6 from the intermediate spindle 1.

The present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A lock set for use in combination with a door latch, comprising:

a handle assembly;

a hollow outer spindle mounted inside said handle assembly for simultaneous rotation therewith;

a key-operated lock mounted inside said handle assembly and having a tail end;

a hollow intermediate spindle adapted to connect with the door latch and having one end connectable to said outer spindle to be driven by said outer spindle;

a turning rod extending inside said outer and intermediate spindles;

a coupler provided inside said outer spindle and including one end connected to one end of said turning rod so as to actuate said turning rod, and another end connected to said tall end so as to be rotated by said tail end, said tail end driving said coupler to rotate only after said tail end has turned idly by a predetermined angle;

a first clutch plate fitted around said turning rod adjacent to said coupler for rotation together with said turning rod;

a second clutch plate movably disposed around said turning rod for sliding along said turning rod in a direction away from or toward said first clutch plate;

said first clutch plate having a cam surface that cams said second clutch plate to move in a direction away from said first clutch plate or permits said second clutch plate to move toward said first clutch plate; and a coiled spring sleeved around said turning rod and seated on said coupler, said second clutch plate being disposed between said coupler and said first clutch plate and biased by said spring toward said first clutch plate.

2. The lock set as claimed in claim 1, wherein said coupler has a hole to receive said tail end, said hole being engageable with said tail end so as to cause said coupler to rotate together with said tail end, said hole having a cross-section larger than that of said tail end so as to permit said tail end to rotate limitedly within said hole so that said tail end idles by a predetermined angle before engaging said hole.

3. The lock set as claimed in claim 2, wherein said hole of said coupler has a shape substantially conforming to a figure eight and is formed by two sectors having tapered ends overlapping each other.

4. The lock set as claimed in claim 1, wherein said coupler includes a neck part and an enlarged head part, said spring being seated on said neck part and abutting against said enlarged head part.

5. A lock set for a door, comprising:

an inner handle assembly;

an outer handle assembly;

a key-operated lock mounted inside said outer handle assembly and having a tail end;

a hollow outer spindle mounted inside said outer handle assembly for simultaneous rotation therewith;

a hollow intermediate spindle having an inner end connected to said inner handle assembly;

a turning rod extending inside said intermediate and outer spindles, and having inner and outer ends;

a coupler disposed inside said outer spindle and having an outer end connected to said tail end of said lock so as to be turned by said lock, and an inner end connected to said outer end of said turning rod so as to actuate said turning rod;

a first clutch plate fitted around said turning rod adjacent to said outer end of said turning rod for rotation together with said turning rod;

a second clutch plate disposed around said turning rod for sliding along said turning rod in a direction away from or toward said first clutch plate;

a coiled spring sleeved around said turning rod and seated on said coupler, said second clutch plate being disposed between said coupler and said first clutch plate and biased by said spring toward said first clutch plate; and said first clutch plate having a cam surface that cams said second clutch plate to move away from said first clutch plate, or permits said second clutch plate to move toward said first clutch plate.

6. The lock set as claimed in claim 5, further comprising a pair of slide plates disposed around said turning rod within said outer spindle, said outer spindle having two diametrically opposed apertures, said slide plates being movable radially outward through said apertures upon rotation of said turning rod.

7. The lock set as claimed in claim 5, wherein said coupler has an inner hole formed in said inner end of said coupler to receive said outer end of said turning rod in snug fit, and an outer hole formed in said outer end of said coupler to receive said tail end.

8. The lock set as claimed in claim 7, wherein said outer hole of said coupler has a narrow cross-sectional shape substantially conforming to that of said tail end so as to receive said tail end in snug fit.

9. The lock set as claimed in claim 7, wherein said outer hole of said coupler has a cross-section larger than that of said tail end so as to permit said tail end to rotate limitedly within said outer hole.

10. The lock set as claimed in claim 7, wherein said outer hole of said coupler has a cross-sectional shape which conforms substantially to a figure eight-shape and which is formed by two sectors having tapered ends overlapping each other.

* * * * *